US009549657B2

(12) United States Patent
Bennett et al.

(10) Patent No.: US 9,549,657 B2
(45) Date of Patent: Jan. 24, 2017

(54) DISHWASHER WITH MULTI-PIECE TUB

(71) Applicant: WHIRLPOOL CORPORATION, Benton Harbor, MI (US)

(72) Inventors: Aaron P. Bennett, Saint Joseph, MI (US); Tod E. Boyd, Findlay, OH (US); Rexford W. Cordill, Granger, IN (US); Donald J. Wilson, Stevensville, MI (US); Marvin R. Mealman, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 854 days.

(21) Appl. No.: 13/622,412

(22) Filed: Sep. 19, 2012

(65) Prior Publication Data

US 2013/0069505 A1 Mar. 21, 2013

Related U.S. Application Data

(60) Provisional application No. 61/537,302, filed on Sep. 21, 2011, provisional application No. 61/570,878, filed on Dec. 15, 2011.

(51) Int. Cl.
*A47L 15/42* (2006.01)

(52) U.S. Cl.
CPC ..... *A47L 15/4219* (2013.01); *A47L 15/4246* (2013.01); *A47L 15/4272* (2013.01); *A47L 15/4255* (2013.01); *Y10T 29/4998* (2015.01)

(58) Field of Classification Search
CPC ..... A47L 15/4219
See application file for complete search history.

(56) References Cited

U.S. PATENT DOCUMENTS

| | | | |
|---|---|---|---|
| 3,091,946 | A | 6/1963 | Kesling |
| 3,822,029 | A | 7/1974 | Butsch |
| 3,826,553 | A | 7/1974 | Cushing et al. |
| 3,862,880 | A | 1/1975 | Feldman |
| 3,913,996 | A | 10/1975 | Benford |
| 3,944,111 | A | 3/1976 | Nonomaque et al. |
| 3,960,631 | A | 6/1976 | Weiss et al. |
| 4,096,872 | A | 6/1978 | Herbst et al. |
| 4,295,692 | A | 10/1981 | Jenkins |
| 4,476,183 | A | 10/1984 | Holtrop et al. |
| 4,707,401 | A | 11/1987 | Benford |
| 4,940,298 | A | 7/1990 | Jackson et al. |
| 4,985,106 | A | 1/1991 | Nelson |
| 5,038,543 | A | 8/1991 | Neyer |

(Continued)

FOREIGN PATENT DOCUMENTS

| | | |
|---|---|---|
| DE | 2016637 | 10/1971 |
| DE | 4319207 A1 | 12/1994 |

(Continued)

OTHER PUBLICATIONS

European Search Report for counterpart EP12185253.7, dated Jan. 28, 2016.

*Primary Examiner* — Jason Ko

(57) ABSTRACT

A dishwasher for automatically executing a cycle of operation for treatment of dishes includes a tub having multiple walls at least partially defining a treating chamber for receiving dishes for treatment wherein at least one of the multiple walls is thermoformed from sheet material and a method of making a tub for a dishwasher.

22 Claims, 12 Drawing Sheets

(56) References Cited

U.S. PATENT DOCUMENTS

| | | | | |
|---|---|---|---|---|
| 5,086,599 | A | 2/1992 | Meyerson | |
| 5,168,621 | A * | 12/1992 | Kruck et al. | 29/451 |
| 5,211,188 | A | 5/1993 | Kraus | |
| 5,324,589 | A | 6/1994 | Willard | |
| 5,368,379 | A | 11/1994 | Wrangberth | |
| 5,374,118 | A | 12/1994 | Kruck et al. | |
| 5,486,407 | A | 1/1996 | Noell et al. | |
| 5,741,054 | A | 4/1998 | Becker et al. | |
| 5,759,591 | A | 6/1998 | Rhoades et al. | |
| 5,924,433 | A | 7/1999 | Thies et al. | |
| 6,435,366 | B1 | 8/2002 | Johnson et al. | |
| 7,156,113 | B2 | 1/2007 | Jerg et al. | |
| 7,405,008 | B2 | 7/2008 | Domine et al. | |
| 7,594,513 | B2 | 9/2009 | VanderRoest et al. | |
| 7,731,309 | B2 | 6/2010 | Gorini et al. | |
| 7,748,796 | B2 | 7/2010 | Rockwell et al. | |
| 7,762,285 | B2 | 7/2010 | Drope et al. | |
| 2004/0173245 | A1 * | 9/2004 | Elick et al. | 134/25.2 |
| 2005/0016569 | A1 | 1/2005 | Rosenbauer et al. | |
| 2005/0285487 | A1 | 12/2005 | Noh | |
| 2006/0090958 | A1 * | 5/2006 | Coates | G10K 11/162 181/290 |
| 2008/0035183 | A1 | 2/2008 | Kuecuek et al. | |
| 2008/0145595 | A1 | 6/2008 | Pratt et al. | |
| 2008/0223421 | A1 | 9/2008 | Rosenbauer et al. | |
| 2008/0309210 | A1 | 12/2008 | Luisi et al. | |
| 2009/0095335 | A1 | 4/2009 | Buehlmeyer et al. | |
| 2009/0102336 | A1 | 4/2009 | Buehlmeyer et al. | |
| 2009/0126765 | A1 * | 5/2009 | Buehlmeyer et al. | 134/115 R |
| 2010/0132749 | A1 | 6/2010 | Buehlmeyer et al. | |
| 2010/0175725 | A1 | 7/2010 | Rosenbauer et al. | |
| 2010/0192990 | A1 | 8/2010 | Hotz et al. | |
| 2011/0168217 | A1 | 7/2011 | Neff et al. | |

FOREIGN PATENT DOCUMENTS

| | | | |
|---|---|---|---|
| DE | 102005019016 | A1 | 10/2006 |
| DE | 102009001260 | A1 | 9/2010 |
| DE | 102009001896 | A1 | 9/2010 |
| DE | 102009026905 | A1 | 12/2010 |
| DE | 102010001367 | A1 | 8/2011 |
| EP | 0348012 | A1 | 12/1989 |
| EP | 0449020 | A1 | 10/1991 |
| EP | 0628662 | A2 | 12/1994 |
| EP | 1249329 | A2 | 10/2002 |
| EP | 1624097 | A2 | 2/2006 |
| GB | 1202013 | A | 8/1970 |
| GB | 2322658 | A | 9/1998 |
| JP | 10127553 | A | 5/1998 |
| JP | 2002282190 | A | 10/2002 |
| JP | 2010005264 | A | 1/2010 |
| WO | 2007068634 | A1 | 6/2007 |
| WO | 2008080933 | A1 | 7/2008 |
| WO | 2009003783 | A2 | 1/2009 |
| WO | 2009004045 | A1 | 1/2009 |

* cited by examiner

DISHWASHER WITH MULTI-PIECE TUB

CROSS-REFERENCE TO RELATED APPLICATIONS

This application claims priority from U.S. Provisional Application No. 61/537,302 filed on Sep. 21, 2011, entitled Dishwasher with Multi-Piece Tub and U.S. Provisional Application No. 61/570,878 filed on Dec. 15, 2011, entitled Dishwasher with Multi-Piece Tub, both of which are incorporated herein by reference in their entirety.

BACKGROUND OF THE INVENTION

Many contemporary dishwashers include a tub having an opening leading to an interior chamber for washing utensils. One or more racks or baskets may be located in the tub for supporting utensils within the tub for treatment according to a cycle of operation of the dishwasher. A pump may be provided for recirculating wash liquid throughout the tub to apply the liquid to any utensils within the racks or baskets. The tub is typically formed from injection molded plastic or stamped and welded stainless steel.

BRIEF DESCRIPTION OF THE INVENTION

One embodiment of the invention relates to a dishwasher for automatically executing a cycle of operation for treatment of dishes, including a tub having multiple walls at least partially defining a treating chamber for receiving dishes for treatment wherein at least one of the multiple walls is thermoformed from sheet material.

Another embodiment of the invention relates to a method of making a tub for a dishwasher, including thermoforming a wrapper from plastic sheet material, folding the wrapper into three walls, and assembling the wrapper with two other walls to form a five-sided tub with an open face.

DESCRIPTION OF EMBODIMENTS OF THE INVENTION

Figure 1:
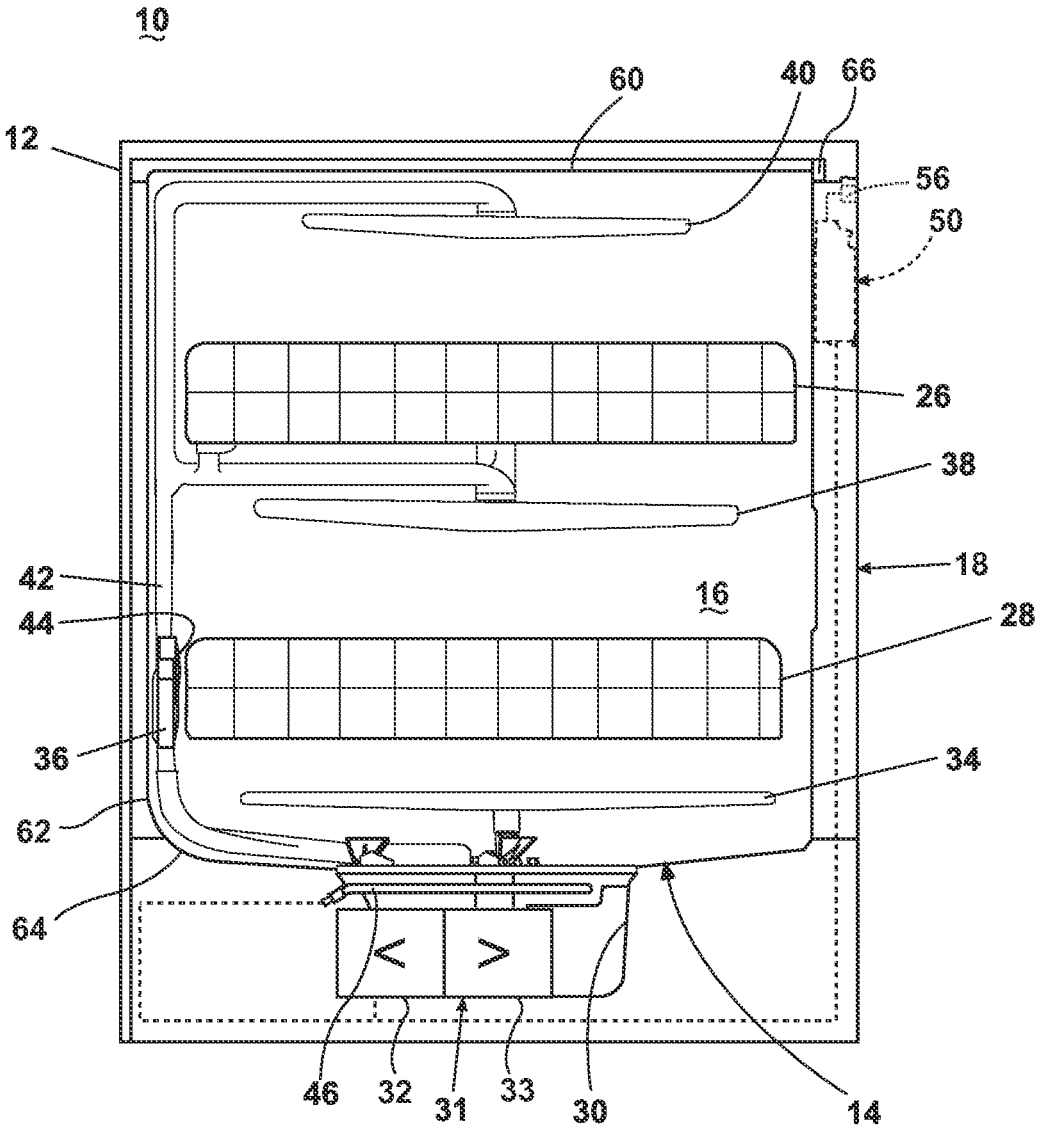
FIG. 1 is a schematic, cross-sectional view of a dishwasher according to a first embodiment of the invention.

In FIG. 1, an automated dishwasher 10 according to a first embodiment is illustrated. The dishwasher 10 shares many features of a conventional automated dishwasher, which will not be described in detail herein except as necessary for a complete understanding of the invention. A chassis 12 may define an interior of the dishwasher 10 and may include a frame, with or without panels mounted to the frame. An open-faced tub 14 may be provided within the chassis 12 and may at least partially define a treating chamber 16, having an open face, for washing utensils. A door assembly 18 may be movably mounted to the dishwasher 10 for movement between opened and closed positions to selectively open and close the open face of the tub 14. Thus, the door assembly provides accessibility to the treating chamber 16 for the loading and unloading of utensils or other washable items.

It should be appreciated that the door assembly 18 may be secured to the lower front edge of the chassis 12 or to the lower front edge of the tub 14 via a hinge assembly (not shown) configured to pivot the door assembly 18. When the door assembly 18 is closed, user access to the treating chamber 16 may be prevented, whereas user access to the treating chamber 16 may be permitted when the door assembly 18 is open.

Utensil holders, illustrated in the form of upper and lower utensil racks 26, 28, are located within the treating chamber 16 and receive utensils for washing. The upper and lower racks 26, 28 are typically mounted for slidable movement in and out of the treating chamber 16 for ease of loading and unloading. Other utensil holders may be provided, such as a silverware basket. As used in this description, the term "utensil(s)" is intended to be generic to any item, single or plural, that may be treated in the dishwasher 10, including, without limitation, dishes, plates, pots, bowls, pans, glassware, and silverware.

A spray system is provided for spraying liquid in the treating chamber 16 and is provided in the form of a first lower spray assembly 34, a second lower spray assembly 36, a rotating mid-level spray arm assembly 38, and/or an upper spray arm assembly 40. Upper sprayer 40, mid-level rotatable sprayer 38 and lower rotatable sprayer 34 are located, respectively, above the upper rack 26, beneath the upper rack 26, and beneath the lower rack 24 and are illustrated as rotating spray arms. The second lower spray assembly 36 is illustrated as being located adjacent the lower utensil rack 28 toward the rear of the treating chamber 16. The second lower spray assembly 36 is illustrated as including a vertically oriented distribution header or spray manifold 44. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system is provided for recirculating liquid from the treating chamber 16 to the spray system. The recirculation system may include a sump 30 and a pump assembly 31. The sump 30 collects the liquid sprayed in the treating chamber 16 and may be formed by a sloped or recess portion of a bottom wall of the tub 14. The pump assembly 31 may include both a drain pump 32 and a recirculation pump 33. The drain pump 32 may draw liquid from the sump 30 and pump the liquid out of the dishwasher 10 to a household drain line (not shown). The recirculation pump 33 may draw liquid from the sump 30 and the liquid may be simultaneously or selectively pumped through a supply tube 42 to each of the assemblies 34, 36, 38, 40 for selective spraying. While not shown, a liquid supply system may include a water supply conduit coupled with a household water supply for supplying water to the treating chamber 16.

A heating system including a heater 46 may be located within the sump 30 for heating the liquid contained in the sump 30.

A controller 50 may also be included in the dishwasher 10, which may be operably coupled with various components of the dishwasher 10 to implement a cycle of operation. The controller 50 may be located within the door 18 as illustrated, or it may alternatively be located somewhere within the chassis 12. The controller 50 may also be operably coupled with a control panel or user interface 56 for receiving user-selected inputs and communicating information to the user. The user interface 56 may include operational controls such as dials, lights, switches, and displays enabling a user to input commands, such as a cycle of operation, to the controller 50 and receive information.

Figure 2:
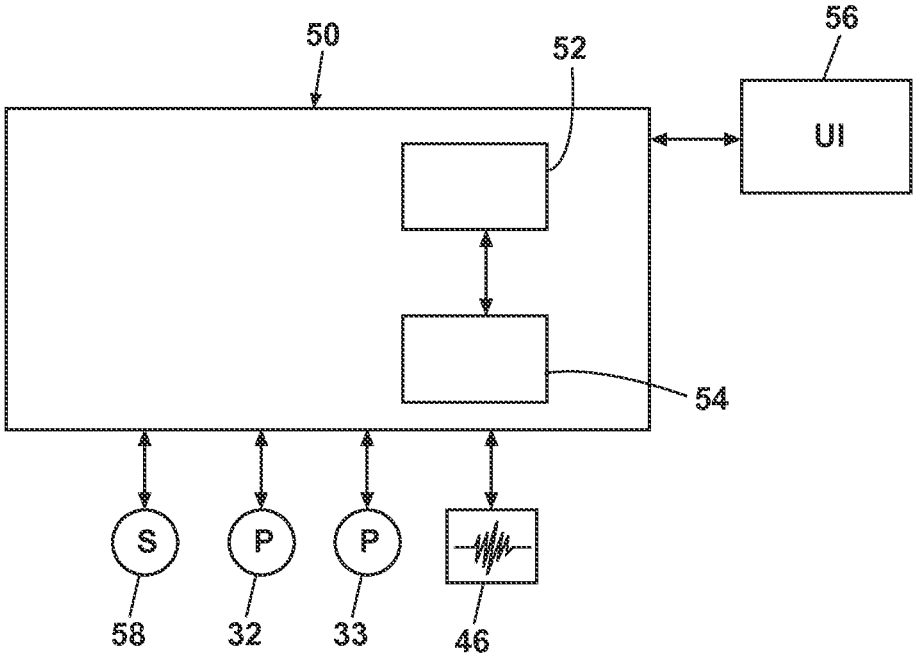
FIG. 2 is a schematic view of a controller of the dishwasher of FIG. 1.

As illustrated schematically in FIG. 2, the controller 50 may be coupled with the heater 46 for heating the wash liquid during a cycle of operation, the drain pump 32 for draining liquid from the treating chamber 16, and the recirculation pump 33 for recirculating the wash liquid during the cycle of operation. The controller 50 may be provided with a memory 52 and a central processing unit (CPU) 54. The memory 52 may be used for storing control software that may be executed by the CPU 54 in completing a cycle of operation using the dishwasher 10 and any additional software. For example, the memory 52 may store one or more pre-programmed cycles of operation that may be selected by a user and completed by the dishwasher 10. The controller 50 may also receive input from one or more sensors 58. Non-limiting examples of sensors that may be communicably coupled with the controller 50 include a temperature sensor and turbidity sensor to determine the soil load associated with a selected grouping of utensils, such as the utensils associated with a particular area of the treating chamber.

The tub 14 includes several improvements in both manufacturing and functionality. Regarding manufacturing, in prior commercially available dishwashers, the tub was most commonly made from metal, plastic, and in a few rare cases a combination of metal and plastic. The metal tub was typically formed by stamping a suitable stainless steel. The plastic tub was typically formed by injection molding a single tub piece from a material such as polypropylene.

The material used to form the tub usually has a variety of properties such that the material may address various requirements for the tub. The typical result is that the resulting performance of the tub is a compromise between strength, aesthetics, sound management, and more. The material of the tub wall must be homogeneous and a relatively high-grade plastic must be used throughout the part to result in an inner surface that has an acceptable appearance and is resistant to food stains. Injected molded plastic tubs have a minimum thickness for the wall of the tub, which is limited by the pressures that may be experienced during the injection molding process.

The use of injection molding practically limits the manufacturing rate as compared to metal stamping. It has been contemplated to thermoform the tubs, which has the benefit of increased production rates for lower cost. Thermoforming is also beneficial over injection molding in that it is less costly and difficult to thermoform tubs of different colors. In thermoforming, to change a color, it is only needed to select a different color sheet. In injection molding, the entire system must be purged of the plastic of the prior color.

However, thermoforming a single-piece tub has its own difficulties, which include tearing and breaking of the plastic as it is less likely to stretch to conform to the mold. Some plastics such as polypropylene may tend to stick to the mold requiring that the mold be patterned or have a sandblasted surface to lessen the potential sticking. Further, to readily release such a thermoformed one-piece tub a draft angle from 1.5° to 2° would be required whereas an injection molded tub only requires 0.5° draft angles. Thus, the thermoformed one-piece tub would have significantly reduced interior space, which would result in reduced rack sizes.

Figure 3:
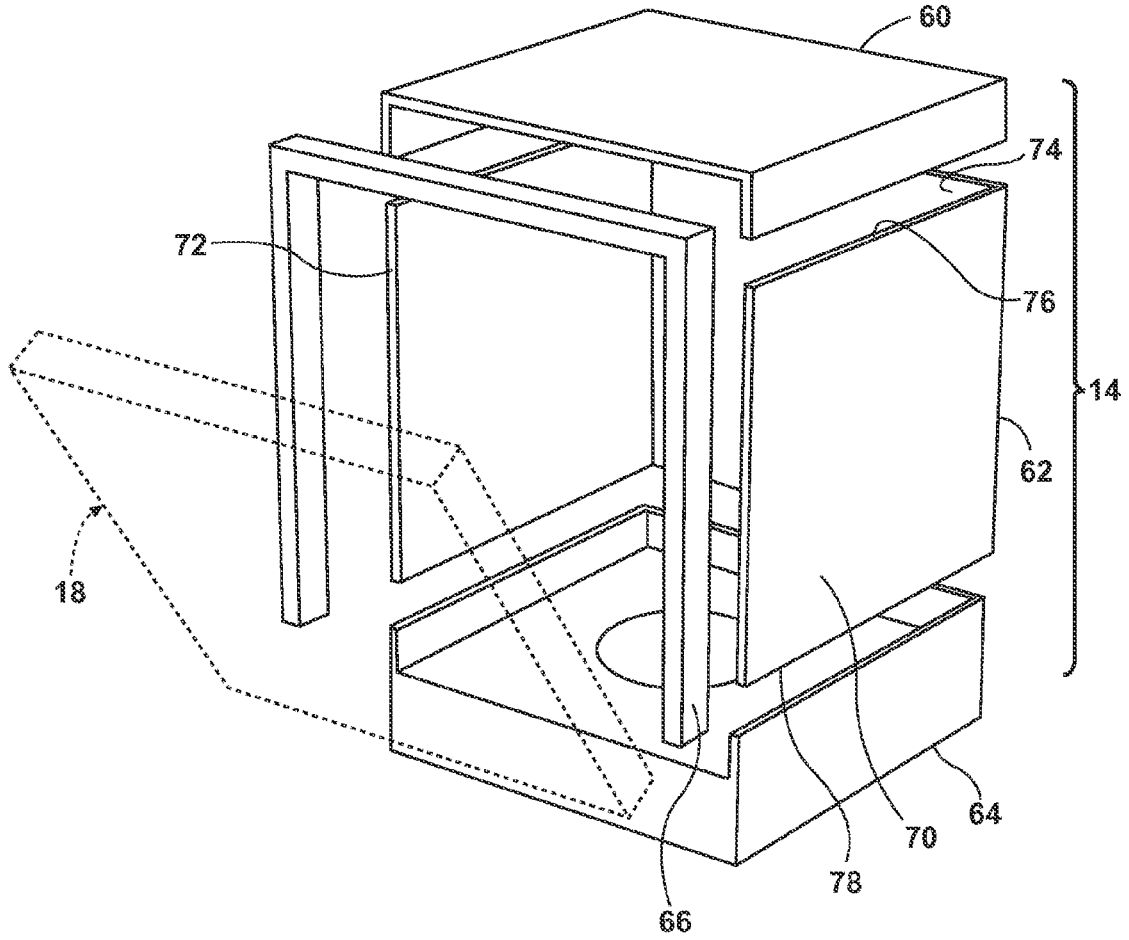
FIG. 3 is a schematic exploded view of pieces of the dishwasher of FIG. 1.

The tub 14 attempts to address these problems by providing a multi-piece tub in which at least some of the pieces are thermoformed, with the resulting tub having sufficient interior volume to hold racks of the size found in contemporary dishwashers. FIG. 3 schematically illustrates an exploded view of an exemplary shell or tub 14 in a three-piece configuration having a top 60, a wrapper 62, and a bottom 64, which may collectively form the tub 14. A tub collar 66 and the door assembly 18 are illustrated for completeness. It is contemplated that the top 60, wrapper 62, and bottom 64 may each be thermoformed. Alternatively, a subset of the components for the tub 14 may be thermoformed and the remainder of the components may be formed in an alternative manner. For example, the remainder of the components may be stamped stainless steel components.

During manufacture, and by way of non-limiting example, the top 60 and bottom 64 may be thermoformed from a single sheet of material or may be thermoformed from separate sheets. The wrapper 62 may be thermoformed from a separate sheet of material and the interior of the door assembly may be thermoformed from another separate sheet of material. Separately thermoforming each component of the tub 14, as well as the interior of the door assembly may provide for a relatively simple manufacturing process and allows for smaller drafts to no drafts on each piece. Further, separately thermoforming each component of the tub 14 allows for the nominal wall thickness of each piece to be different.

Figure 4:
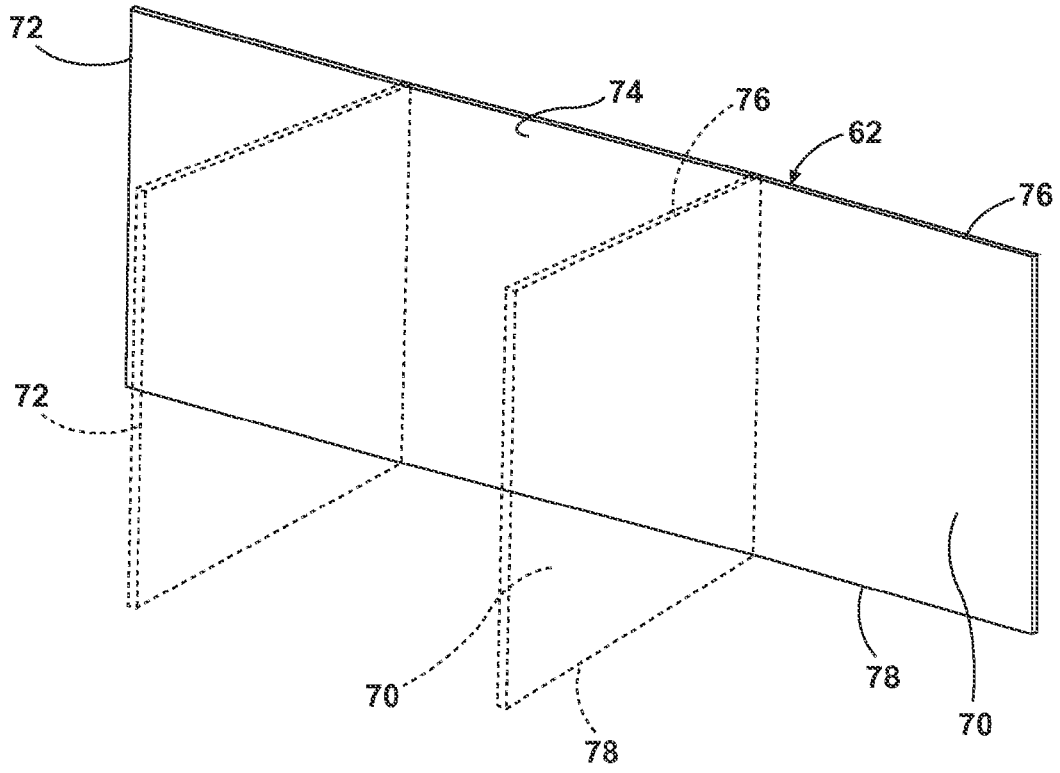
FIG. 4 is a schematic view of a wrapper being formed for the dishwasher of FIG. 3.
Figure 5:
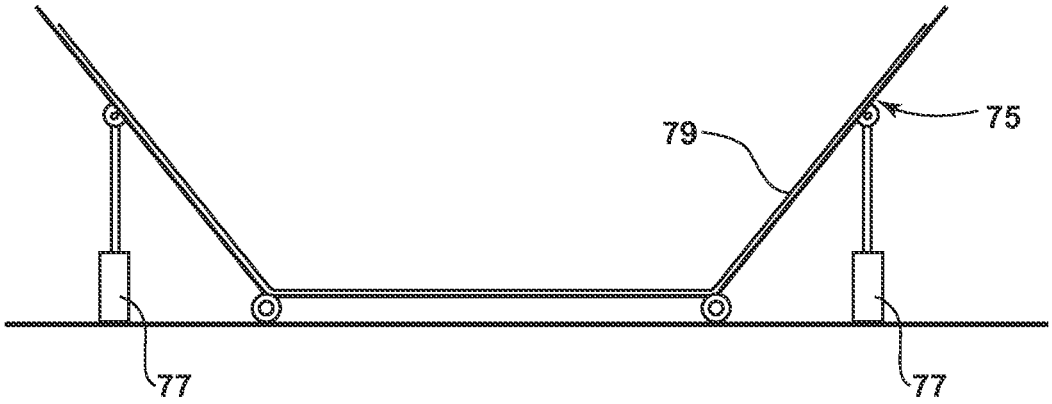
FIG. 5 is a schematic of an articulating clamping frame, which may be used to form a wrapper for the dishwasher of FIG. 3 according to another embodiment of the invention.

It is contemplated that the wrapper 62 may be thermoformed as a relatively flat piece (FIG. 4), with or without fold lines, which may then be pre-heated and folded such that the wrapper 62 has first and second opposing side walls 70, 72 (shown in phantom in FIG. 4) that are interconnected by a rear wall 74. Alternatively, a three-dimensional wrapper 62 may be created during the thermoforming process wherein no subsequent pre-heating and folding of the wrapper 62 would be required. For example, it is contemplated that the wrapper 62 may be formed using an articulating clamping frame 75 (shown in FIG. 5). Typically, in thermoforming, a sheet is clamped into a clamping frame to secure the edges of the sheet during heating and subsequent forming A typical clamping frame keeps the sheet in a single plane and a vacuum is pulled to draw the sheet into a single mold. The articulating clamping frame 75 has pneumatic cylinders 77 that transition portions of the frame 75 from the flat to a U-shape after a sheet of material 79 is softened by heating. A vacuum may then be pulled to draw the sheet 79 into molds located adjacent to each segment of the U-shape.

The first and second opposing side walls 70, 72 and rear wall 74 include corresponding upper edge portions 76 and lower edge portions 78. Subsequently, the top 60 may be joined to the upper edge portions 76 of each of the first and second opposing side walls 70, 72 and rear wall 74 of the wrapper 62 and the bottom 64 may be joined to the lower edge portion 78 of each of the first and second opposing side walls 70, 72 and rear wall 74 of the wrapper 62. By way of non-limiting example, the top 60, wrapper 62, and bottom 64 may be joined together with the use of a hot melt adhesive. The hot melt adhesive may be any suitable thermoplastic adhesive such as a polyolefin. Alternatively, a sealant may be used to join the components together. The sealant may be any suitable type of sealant such as a polyurethane reactive (PUR) sealant, which may be characterized by strong adhesion to substrates, the ability to withstand temperature extremes and harsh environments, and having sufficient flexibility to permit the joining of materials having radically different thermal coefficients of thermal expansion without incurring failures at temperature extremes. Regardless of whether a hot melt adhesive is used or a sealant is used, it may act to fill any variation in joints between the parts of the tub 14 and may aid in forming a water tight seal. Such an adhesive or sealant may be used if all of the components of the tub 14 or any subsets of the components are thermoformed. When the top 60, wrapper 62, and bottom 64 are joined together they form the tub 14 having a front opening.

It will be understood that various other methods for joining the components of the tub 14 may be used including various welding techniques and/or various adhesives. For example, other adhesive types may be used and may act as both a structural adhesive and a sealant. It is contemplated that a simple mechanical joining process or fastener may be used to hold the components of the tub 14 together until the adhesive can completely cure. This may be the result of station times, which are too brief to allow the adhesive to develop adequate strength before the tub 14 is moved to the next station. The mechanical joint may then be redundant or may be removed.

During subsequent assembly, the tub collar 66 may be attached to the tub 14. Any suitable tub collar 66 may be used and may provide support and a finished appearance for the tub 14 as well as a sealing surface for the door assembly 18. Once completed, the tub 14 and tub collar 66 may be integrated into the dishwasher 10 during final assembly and the door assembly 18 may be movably mounted to the dishwasher 10 for movement between opened and closed positions to selectively open and close the open face of the tub 14. The forming and assembly of the components of the tub 14, including the bending of the wrapper 62, may be separated in time and place from each other and from the joining and assembly of such components to each other and to the remainder of the components of the dishwasher 10.

The material that may be used to thermoform any of the top 60, wrapper 62, and bottom 64 may include any suitable thermoformable material, such as a polypropylene sheet. Alternatively, the thermoformable material may include polyethylene terephthalate or polybutylene terephthalate. It is contemplated that these materials may include recycled material from the marketplace and/or regrind material from within the manufacturing facility, both of which may enhance the "green" nature of the tub 14.

Figure 6:
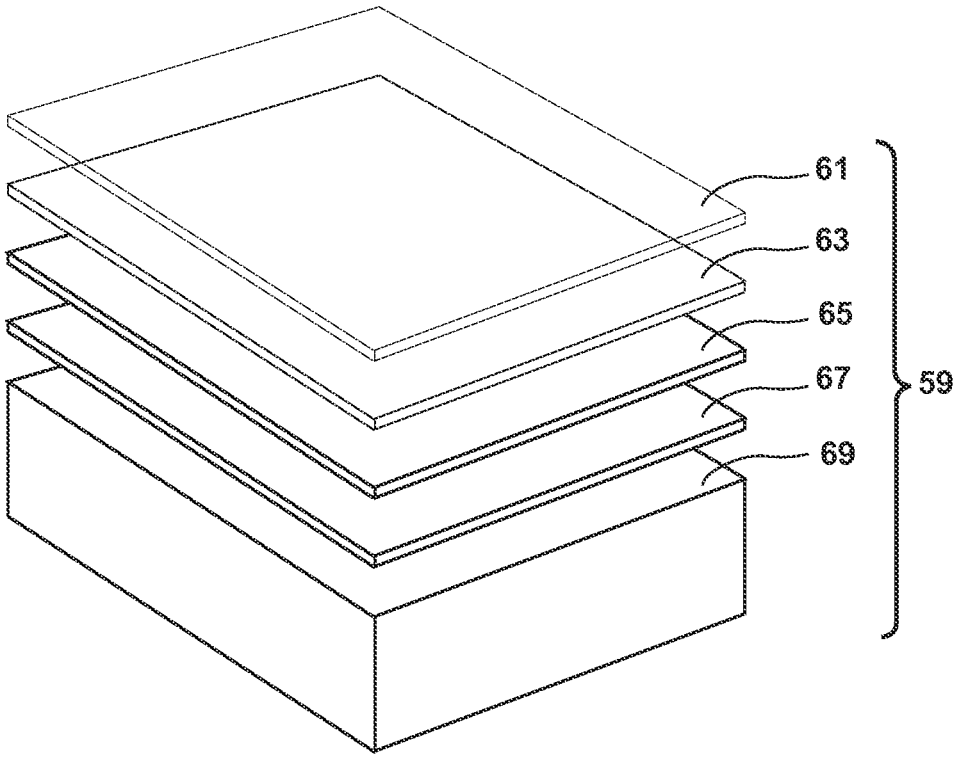
FIG. 6 is an exploded view of a multi-layer material which may be used to thermoform a piece of the dishwasher of FIG. 3.

The thermoformable material may be one or more layers. In the case of multiple layers, one or more of the layers may have differing functions and/or differing properties. By way of non-limiting example a multi-layer material 59, illustrated in FIG. 6, may include an interior layer 61, which may correspond to the interior of the tub 14. Such an interior layer 61 may be tough, impact-resistant, stain-resistant, and abrasion-resistant. Such an interior layer 61 may form an opaque layer or a transparent gloss layer on the interior surface of the tub 14. The interior layer 61 may be developed to optimize the surface tension for enhanced drying performance of the interior surface of the tub 14. It is contemplated that the stain-resistant interior layer 61 may be formed from oriented polypropylene. Further, the interior layer 61 may overlay non-stain resistant layers. For example, behind the interior layer 61, working towards what would be the exterior of the tub 14, an aesthetic layer 63 may be included, which may include one or more colors, as well as one or more patterns. By way of non-limiting example, the aesthetic layer 63 could include a faux stainless steel pattern, which may show through the interior layer 61. Such an aesthetic layer 63 may allow the interior to appear in a variety of exotic colors and patterns. Behind the aesthetic layer 63, an acoustic layer 65 could be included to dampen wash impingement noise. The acoustic layer 65 may be made of any suitable material and may provide attenuation of sound in a targeted frequency range. Further, a tie layer 67 may be included to adhere the other layers to a structure layer 69, which may include a low-cost layer that may provide the structural stiffness of the multi-layer sheet. Such a structural layer 69 need not be aesthetically pleasing and may be composed of approximately thirty-five to forty percent regrind polypropylene. Although the structural layer 69 has been illustrated as a single layer it may be composed of two layers wherein the first structural layer, adjacent the tie layer 67, would include recycled and/or regrind material and the second structural layer would be composed of virgin material. The benefit of this second structural layer is to introduce new material into the material stream to prevent buildup in the regrind over time of the materials in the non-structure layers as the regrind material would not be used in the non-structure layers but all of the layers end up in the composition of the regrind. Further, special-purpose layers (not shown), such as a metal foil layer, which may provide heat transfer retardation, may be included. Such special-purpose layers may have additional properties and characteristics not described above. Such a multi-layer material 59 may be extruded and/or laminated to create a multi-layer sheet, which may subsequently be thermoformed to form any components of the tub 14.

It is contemplated that the multi-layer material 59 may include multiple sound attenuating layers. Each of the multiple sound attenuating layers may be tuned to attenuate a different frequency. Such sound attenuating layers act on the principles of Mass Law and Transmission Loss by dissipating the vibration into a low-temp frictional heat and reducing sound traveling through the material. The frequency range that may be attenuated by the layers may be from 80 to 10,000 Hz. The primary noise sources being mitigated are wash noise, which may include broadband noise in the range from 315-2,000 Hz, from water splashing or impinging on the inside tub wall and low frequency excitation of the tub structure due to motor and/or pump vibration, which may include noise in the range of 100-200 Hz. Thus, one of the sound attenuating layers may be tuned to attenuate noise in the range from 100-200 Hz while another may be tuned to attenuate noise in the range from 315-2,000 Hz, and yet another may be tuned to attenuate noise above 2,000 Hz.

It is also contemplated that two layers of the multi-layer material may have different thermal expansion properties;

for example, the two layers may have very different thermal coefficients of expansion. In such an instance the two layers having the different thermal expansion properties may be separated by a flexible layer, which may allow for different expansion between the two different layers having the different thermal expansion properties without the laminate cracking, etc. More specifically, during operation the flexible layer may undergo significant strain to alleviate strains within the more rigid layers above and below it. The inclusion of the flexible layer may reduce the likelihood of failure of the material. Without the flexible layer, appreciable changes in temperature may result in greater expansion or contraction of one layer compared to another, which may result in failure of the material by excessive bowing or fracture.

Figure 7:
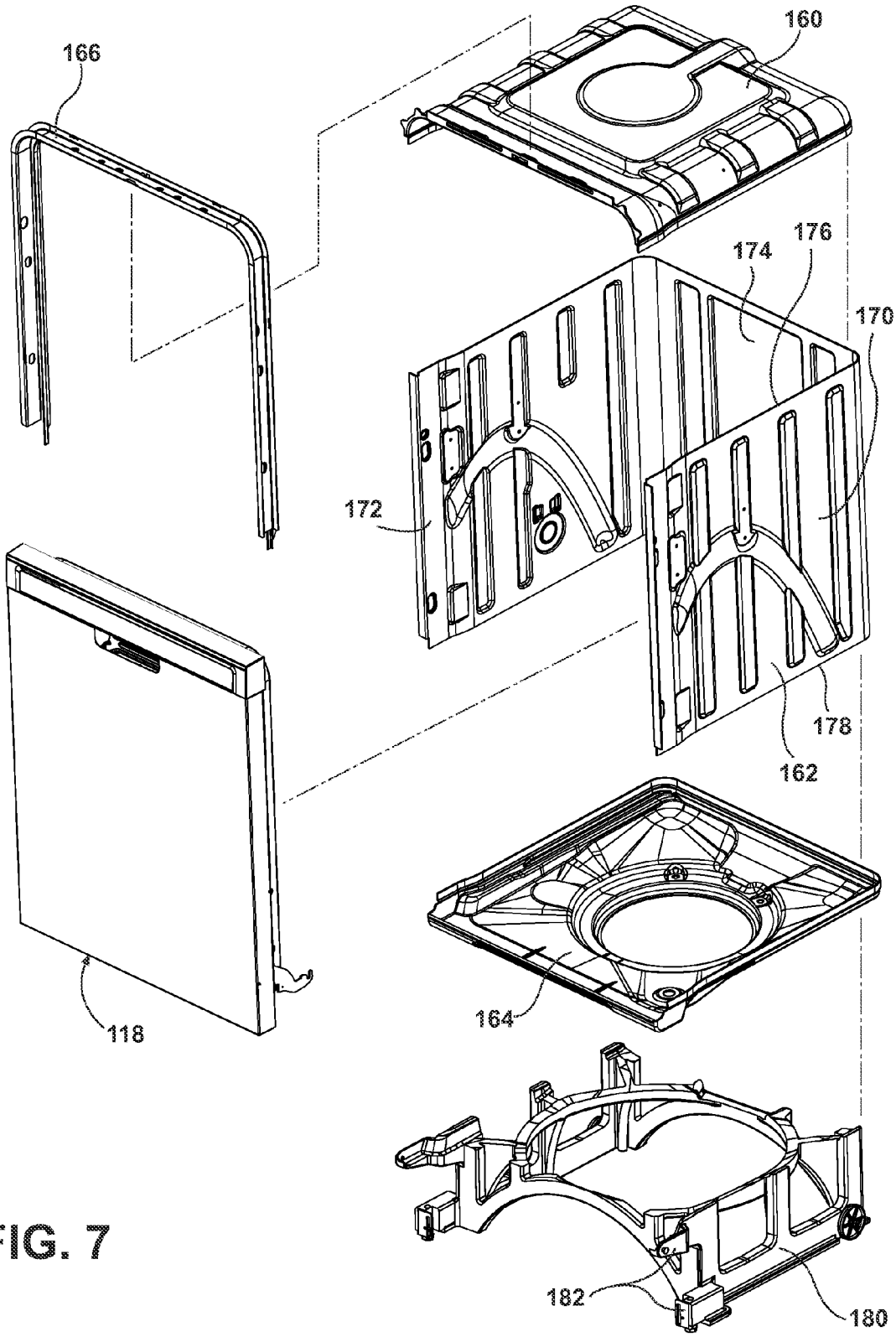
FIG. 7 is an exploded view of pieces of a dishwasher according to a second embodiment of the invention.

FIG. 7 illustrates an alternative top 160, wrapper 162, and bottom 164, which may collectively form a tub 114, as well as a tub collar 166, a door assembly 118, and a base structure 180 according to a second embodiment. The second embodiment is similar to the first embodiment; therefore, like parts will be identified with like numerals increased by 100, with it being understood that the description of the like parts of the first embodiment applies to the second embodiment, unless otherwise noted.

One difference between the tub 114 and the tub 14 is that the base 180 is illustrated as supporting the bottom 164. Contemporary dishwashers may have a multitude of steel components, which are used for the base of the dishwasher. Such steel components are not optimal for locating and attaching system components without the use of an intermediate structure. The base 180 unlike the contemporary steel parts has been designed such that system components and controls may be located and mounted directly to the base 180. That is the base 180 may have structural features conducive to locating and attaching components, which may include by way of non-limiting examples electric motors, pumps, sump units, etc.

The base 180 may be formed from any suitable rigid low-density material. By way of non-limiting example the base may be formed from a single piece of expanded polypropylene (EPP). It is contemplated that EPP having a density of 3.5 to 3.75 pounds per cubic foot may be best suited for the base 180 but that the base 180 need not be limited to having a density in that range. An additional non-limiting example may include that the base is formed from long-glass reinforced thermoplastic material. For ease of explanation, the remainder of this description will focus on a base 180 formed from EPP.

The EPP base 180 may be insert-molded with the bottom 164 of the tub 114 to easily attach the base 180 to the bottom 164 regardless of whether the bottom 164 is made from a thermoformed material or a stainless steel material. Such a process requires no fasteners, the bottom 164 is merely placed into a mold and the EPP is molded up against the bottom 164 to form an attached base 180. It is contemplated that the EPP base 180 may include steel part inserts 182 such that a hybrid EPP and steel structure may be achieved. Any multi-functional steel part inserts 182 may be molded into the EPP part. More specifically, such steel part inserts 182 may be inserted into the mold before the polypropylene is expanded. The steel part inserts 182 may be located to aid in attaching the hinge pin, levelers, and door balance system. Alternatively, the base 180 could be composed of two or more parts molded in-the-flat and then folded at designated break-points to form the three-dimensional base 180. The two or more parts could be fitted together using a tongue-in-groove joint.

Figure 8:
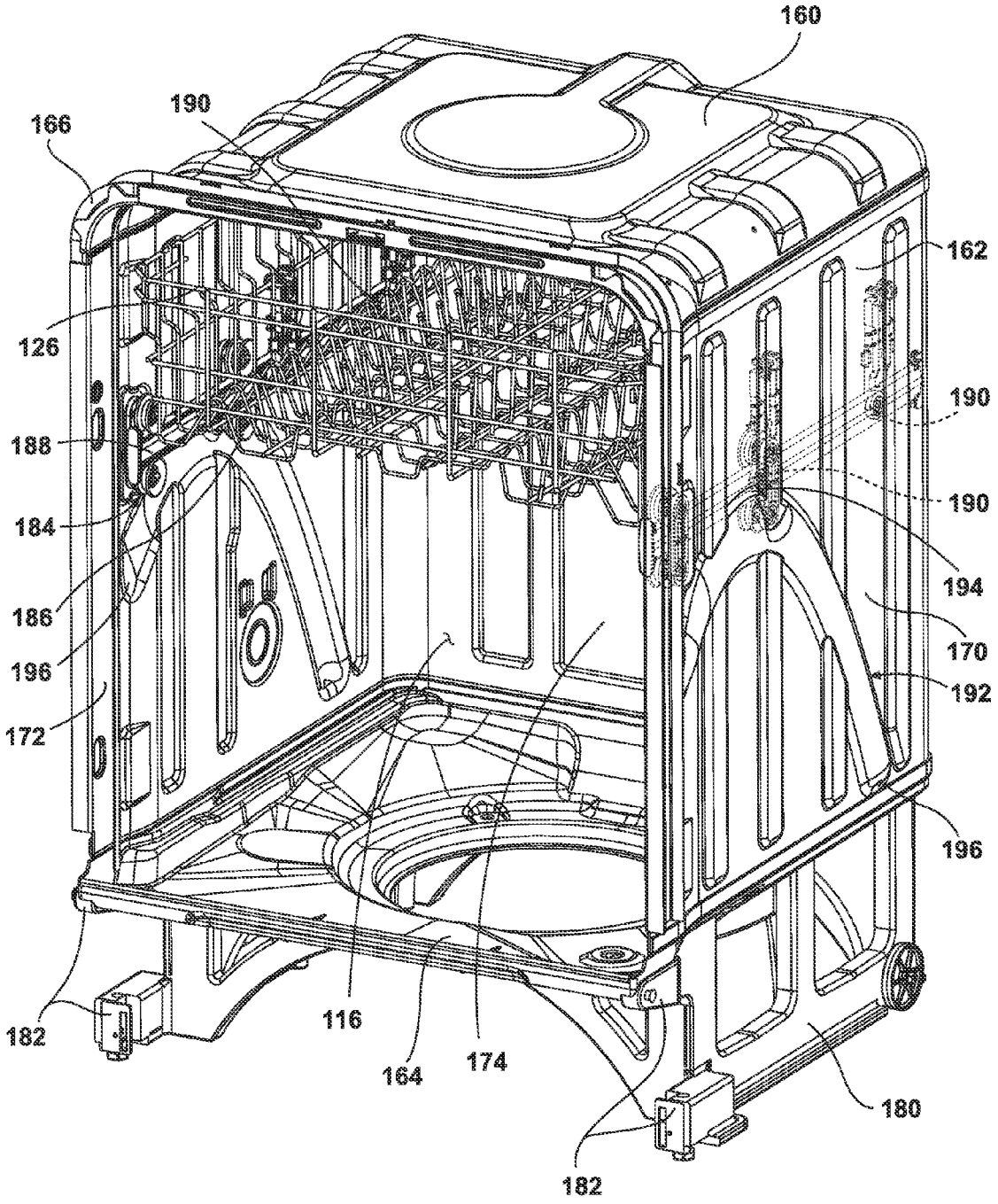
FIG. 8 is a perspective view of pieces of the dishwasher of FIG. 7 along with an upper rack and a rack mount assembly.

As illustrated in FIG. 8, the upper rack 126 may be supported within the treating chamber 116 and slidably mounted to the tub 114 by rack mounts 184. By way of non-limiting example, the rack mounts 184 may include sets of support rollers 186 mounted to the inside of each of the side walls 170, 172 of the wrapper 162 as well as a slide 188 on either side, which may be movably supported within the sets of support rollers 186. A set of rollers 190 mounted to each side of the upper rack 126 may operably couple with the slides 188 to allow the upper rack 126 to slide freely along the set of slides 188. Thus, the upper rack 126 may roll along the set of slides 188 as the set of slides 188 move horizontally along the support rollers 186 so that the upper rack 126 may slide far enough with the rack mounts 184 to move completely out of the treating chamber 116. It has been contemplated that any other type of rack mount or any other mechanism suitable for facilitating movement of the racks between the use and load positions may be utilized.

Another difference between the tub 114 and the tub 14 is that the top 160, wrapper 162, and bottom 164 have been thermoformed to have various features. As with the first embodiment any of the components of the tub 114 may be thermoformed. For ease of explanation, the remainder of this description will focus on a thermoformed wrapper 162.

An arc 192 may be formed in the side walls 170, 172 of the wrapper 162 during thermoforming. Each arc 192 has a top 194, which may be located near the rearward support roller 186 of the rack mount 184. The footings 196 of each arc 192 may be located at the front and back edges of each of the side walls 170, 172. Although the arc 192 has been illustrated and described as having certain characteristics and shape it is contemplated that the arc 192 may have varying heights, widths, and orientations with respect to the side walls 170, 172. For example, it is contemplated that the arc may more closely resemble a full arch or a greater portion of an arch. The arc 192 may include a change in the cross section of the sidewalls 170, 172. The sidewalls 170, 172 may generally define a plane and the arc 192 may project beyond the plane. The arc 192 may have a concave cross section. A rack mount may be located on the arc 192. The rack mount may be provided on one of the sidewalls 170, 172 to support a dish rack within the treating chamber 216 and the arc 192 may form a structural support in the sidewall at a location relative to the rack mount to carry a load applied to the sidewall via the rack mount. It is contemplated that an alternative structural support may be included in the sidewalls 170, 172.

The embodiments described above having multi-piece tubs with thermoformed pieces may result in a dishwasher tub that has several advantages. First, the starting sheet thickness is not limited by molding pressures so thinner tub walls are possible, which may result in less materials being needed, which in turn may result in lower production costs. Second, the manufacture of the components for a multi-piece tub is simplified and each component has minimal draft. The thermoformed components may be easily stacked and shipped in a nested configuration to a final location where the components may be joined to form the multi-piece tub. Further, the separate components of the dishwasher may be constructed in various locations and then readily and inexpensively transported to a control location for final assembly and shipment to wholesalers, consumers, etc. Colorant may be added to the material during forming of the thermoformable sheet, so the determination of color may be separated from thermoforming in time and space. Further, no purge is required to change from one color to another.

Further, the multi-layer material that may be used in thermoforming any of the components of the multi-piece tub allows for additional benefits including flexibility during manufacturing and improved tub properties. Further, numerous multi-layer materials could be created allowing for flexibility in the manufacturing process and for different multi-piece tubs to be easily created. Such changes may take place with little or no interruption at the thermoforming station. The multi-layer materials may differ by color, gloss, pattern, acoustic properties, percent regrind in the structural layer, and the like. By way of additional non-limiting example, a more value oriented multi-layer material may include only a cap or interior layer and a structural layer instead of including the additional multiple layers described above. Alternatively, other product lines could include various combinations of the layers described above. The numerous multi-layer materials may allow for the differentiation of brands and models based on appearance and performance. Further, each component of the multi-piece tub may be formed from a different multi-layer configuration allowing each component to have varying properties suited to its purpose. The multi-layer materials allow the manufacturer to address specific requirements of each component at a minimum cost. Further, such thermoformed tub components may be combined with stainless steel components to further extend the variety and differentiation for various brands and models and provide additional tub properties.

The base described above provides several benefits over contemporary dishwasher base structures, which have multiple stamped steel parts that are slender and prone to damage during shipping and handling and have significant dimensional variations, which lead to inconsistent location of the hinge pin affecting door to tub sealing and latching. The base 180 on the other hand is dimensionally accurate and aids in the accurate placement of the hinge pin relative to the multi-piece tub. Further, the base includes relatively thick sections which have both high bending and torsional rigidity. The low-cost tooling associated with EPP parts may allow for different design configurations for various dishwasher brands. Further, the base may stabilize and inhibit the buckling of any steel structural members that are located in the base. The base may also provide potential sound management during use of the dishwasher. The base may be resistant to corrosion and may have other properties that allow for it to more effectively house components. The base may have improved compressive strength for clamp loads. The stiffness of the base may minimize stress concentrations. Further, the base may act to support a thermoformed tub bottom to inhibit creep. If steel part inserts are located in the base they may also provide benefits such as higher-strength at connection points and improved creep resistance.

The base may also provide several advantages during the shipping, storing, and handling of the dishwasher. For example, packaging material can be replaced, in part, by the base. By way of non-limiting example the base may be used as a replacement for a traditional shipping skid. Further, the base may act to distribute loads during shipping and storage including when dishwashers are stacked on top of each other. The rigid low-density material of the base may also provide benefits such as energy management when the dishwasher is dropped or handled roughly. The EPP base may recover its shape and most of its impact protection.

Figure 9:
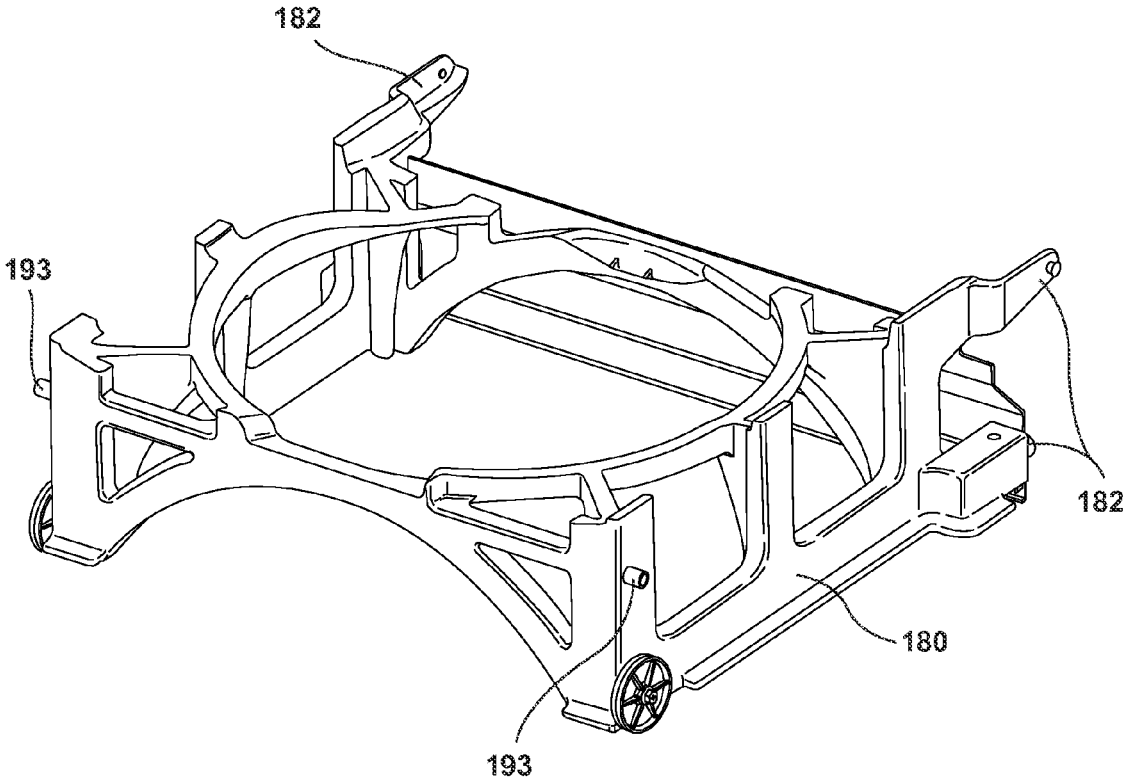
FIG. 9 is a perspective view of an alternative base for use with the dishwasher of FIG. 7 according to yet another embodiment of the invention.

As illustrated in the alternative embodiment shown in FIG. 9, it is contemplated that a cross tube 193 may be embedded within the EPP forming the base 180 to increases the strength of the base 180. Such a cross tube 193 may be formed from any suitable material including galvanized steel. The inclusion of such a cross tube 193 may enhance the resistance of the base 180 to damage done by clamp trucks that may squeeze the packaged dishwasher.

The arc formed in the tub sidewalls also provides several benefits over contemporary dishwashers. In contemporary dishwashers the weight of the loaded upper rack is transferred to the side walls by the rack mounts and such vertical load subjects the tub walls to an edgewise compression resulting in buckling of the wall. Contemporary dishwashers may include a pattern of ribs projecting from the surface of the side wall to stiffen regions of the tub wall. However, the ribs are loaded during compression and they easily deform resulting in inhibited transfer of the load. Further, a significant area of the tub wall remains unsupported by ribbing and the thin wall in these regions may experience buckling resulting in excessive displacement of the tub wall such that the operation of the rack slides is inhibited. As the dishwasher is often at high temperatures due to the wash and rinse cycles the tub in the contemporary dishwasher may also experience creep of the material. With the inclusion of the arc in the sidewalls the tub geometry affords sufficient structure to resist the rack loads. The arc is used to support the rack loads and transfer those loads through the span of the arc to the edges of the side walls at a lower elevation. The edgewise compression of the tub wall is significantly reduced and the propensity of the tub wall to buckle is decreased. It is contemplated that one or more additional features, such as an additional geometric feature, may be included in the side walls 170, 172 to maintain the shape of the arc 192 within each of the side walls 170, 172 when the upper rack 126 is fully loaded.

Figure 10:
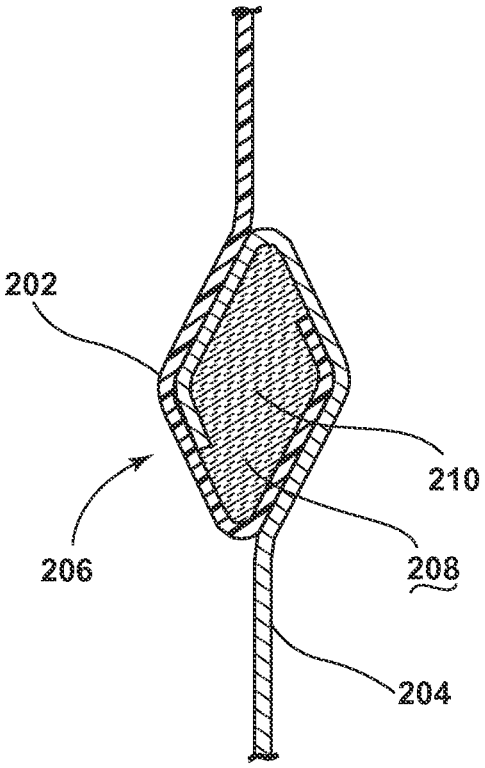
FIG. 10 is a schematic view illustrating how pieces of the dishwasher of FIG. 1 and FIG. 7 may be joined according to an embodiment of the invention.

It is contemplated that the components of the tubs described above may be joined according to an additional embodiment of the invention. FIG. 10 illustrates schematic cross sections of two tub components 202 and 204. The two tub components 202 and 204 are illustrated as being formed from dissimilar materials. By way of non-limiting example only, the schematically represented tub component 202 may be a lower edge portion of a wrapper thermoformed as described above and the schematically represented tub component 204 may be an upper edge of a bottom formed from stainless steel. Alternatively, the two tub components 202 and 204 may be formed from the same material.

Regardless of the composition of the two tub components 202 and 204, the edge of each of the two tub components 202 and 204 may be bent into a similar configuration such that the two tub components 202 and 204 may have mating geometries and/or the same shape. For example, the two tub components 202 and 204 may each have a hook-shaped end and have been illustrated with a diamond-shaped cross section interrupted by corresponding first and second openings. The diamond-shaped cross section has multiple facets and the at least one of the first and second openings is provided in one of the facets. The similar configurations may include corresponding bends in the edge of each of the two tub components 202 and 204 such that when the two tub components 202 and 204 are interlocked, a joint 206 having a void or an enclosed space 208 may be formed. It is contemplated that any suitable bent configuration may be used for the edge of each of the two tub components 202 and 204 and that any suitably shaped enclosed space 208 may be formed and that the configuration illustrated is merely for exemplary purposes. It is contemplated that the interlocking joint 206 may have a low profile and be robust to dimensional variation such that the bent configuration and resulting interlocking joint 206 may be achieved about a curvature in corners of the tub.

A sealant or adhesive 210 may be included within the enclosed space 208 formed by the interlocking joint 206. It is contemplated that when the two tub components 202 and 204 are interlocked that the interlocking joint 206 forms a mechanical joint until the adhesive 210 has time to cure. As explained above, any suitable type of adhesive 210 may be used and may act as both a structural adhesive and a sealant. For example, it is contemplated that under the load, the cured adhesive 210 may have multiple structural purposes including that it may adhere the surfaces of the interlocking joint 206 under shear forces. The adhesive may also prevent distortion of the configurations of the edges of the two tub components 202 and 204. More specifically it may prevent opening or closing of the cross section of the bent configuration of the two tub components 202 and 204 during tension and compression; thus producing a more rigid interlocking joint 206. The adhesive 210 also may act as a sealant to form a watertight enclosure. Further, it is also contemplated that the bent configuration of the two tub components 202 and 204 may form a tortuous path for any attempted migration of moisture.

Figure 11:
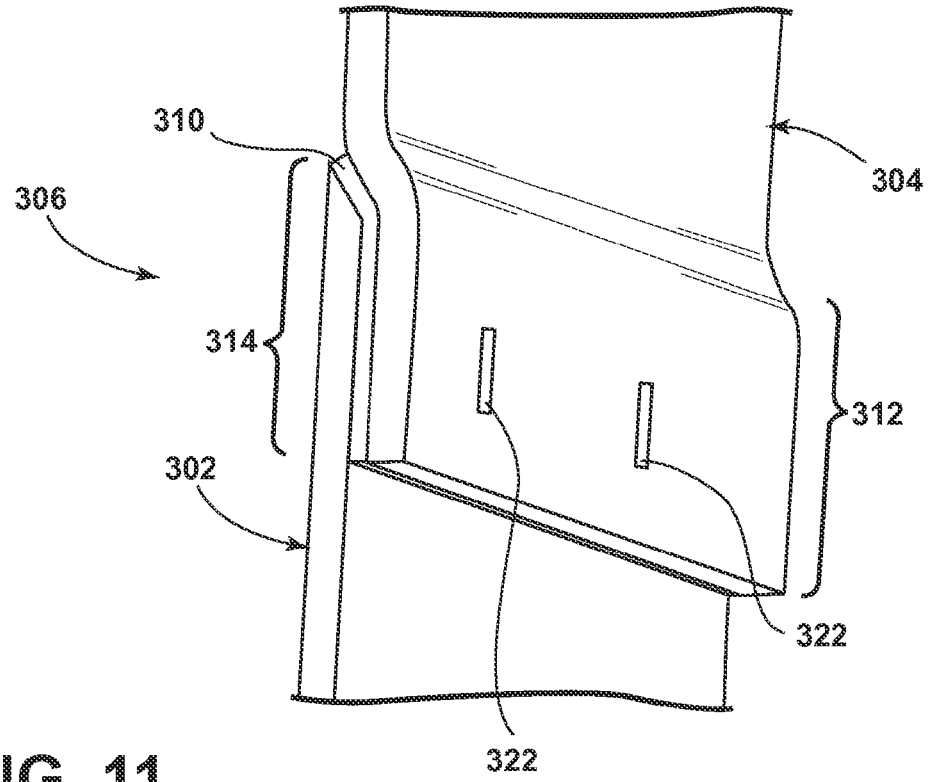
FIG. 11 is a perspective view illustrating how pieces of the dishwasher of FIG. 1 and FIG. 7 may be joined according to another embodiment of the invention.

FIG. 11 illustrates another embodiment of joining two tub components 302 and 304 to form a joint 306. The embodiment illustrated in FIG. 11 is similar to the embodiment in FIG. 10; therefore, like parts will be identified with like numerals increased by 100, with it being understood that the description of the like parts applies to the embodiment in FIG. 11, unless otherwise noted.

One difference is that instead of the edges being bent into a similar configuration as described above the two tub components 302 and 304 may have overlapping portions with mating configurations. More specifically, the tub component 304 is illustrated as being bent to accommodate an upper portion of the tub component 302 and such that a portion 312 of the tub component 304 overlaps with an adjacent portion 314 of the tub component 302. It is contemplated the tub components 302 and 304 may be configured in a variety of ways to provide such overlapping portions 312 and 314 between the two tub components 302 and 304 and that the configuration illustrated is merely for illustrative purposes.

A sealant or adhesive 310 may be included between the overlapping portions 312 and 314 of the two tub components 302 and 304. As explained above, any suitable type of adhesive 310 may be used and the adhesive 310 may act as both a structural adhesive and a sealant. By way of non-limiting example, the adhesive 310 may be dispensed in liquid form between the overlapping portions 312 and 314. By way of additional non-limiting example, the adhesive 310 may be a pressure-sensitive adhesive tape initially applied to the surface of one of the overlapping portions 312 and 314. It is contemplated that the adhesive 310 may be in a continuous layer between the overlapping portions 312 and 314 such that it may form a seal as well as a fastener.

Figure 12:
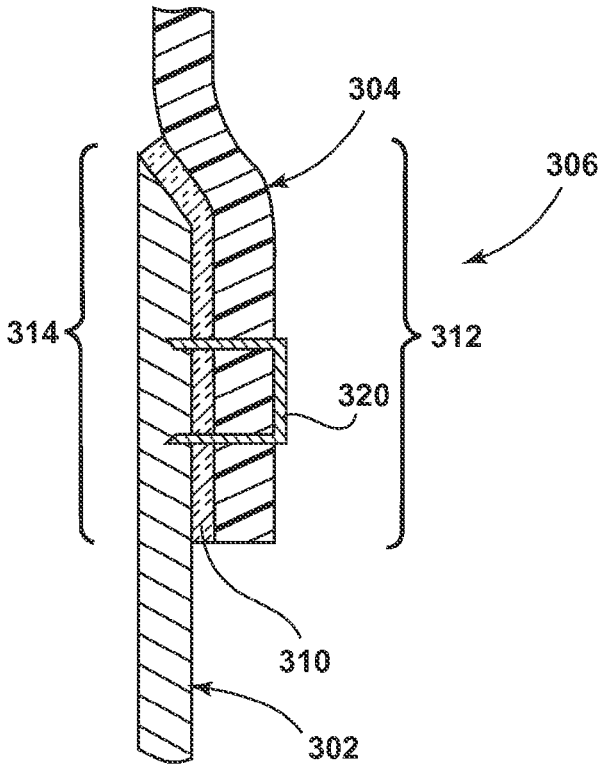
FIG. 12 is a cross-sectional view of the joined pieces of FIG. 11 including a fastening means.

Further, it is contemplated that a mechanical fastener 320 may be used at the joint formed by the overlapping portions 312 and 314 and the adhesive 310. Either or both of the tub components 302 and 304 may include openings 322 for accommodating such a mechanical faster 320 or the mechanical faster 320 may be embedded within the tub components 302 and 304. By way of non-limiting example, FIG. 12 illustrates that the mechanical fastener 320 may include a staple that may go through the tub component 304 and be embedded within the tub component 302. It is contemplated that the mechanical faster may be inserted within the openings and may pierce through the adhesive 310 or that the mechanical fastener 320 may pierce through the tub component 304, the adhesive 310, and be embedded within the tub component 302. It is contemplated that multiple mechanical fasteners 320 may be used to maintain the attachment of the two tub components 302 and 304 during handling until the adhesive 310 is cured and has developed strength over time. It is contemplated that the mechanical fasteners 320 may be spaced intermittently around the extent of the joint formed between the overlapping portions 312 and 314. It is also contemplated that the mechanical fasteners may not be visible from within the treating chamber.

The adhesive 310 and the mechanical faster 320 reinforce each other and allow the joint of the tub components 302 and 304 to take advantage of the strengths afforded by each. For example, the adhesive 310 may support shear forces exerted on the joint while the mechanical fastener 320 may support forces which may otherwise result in peeling of the adhesive 310. Further, it is contemplated that the adhesive 310 may lock the mechanical fastener 320 into place.

Figure 13:
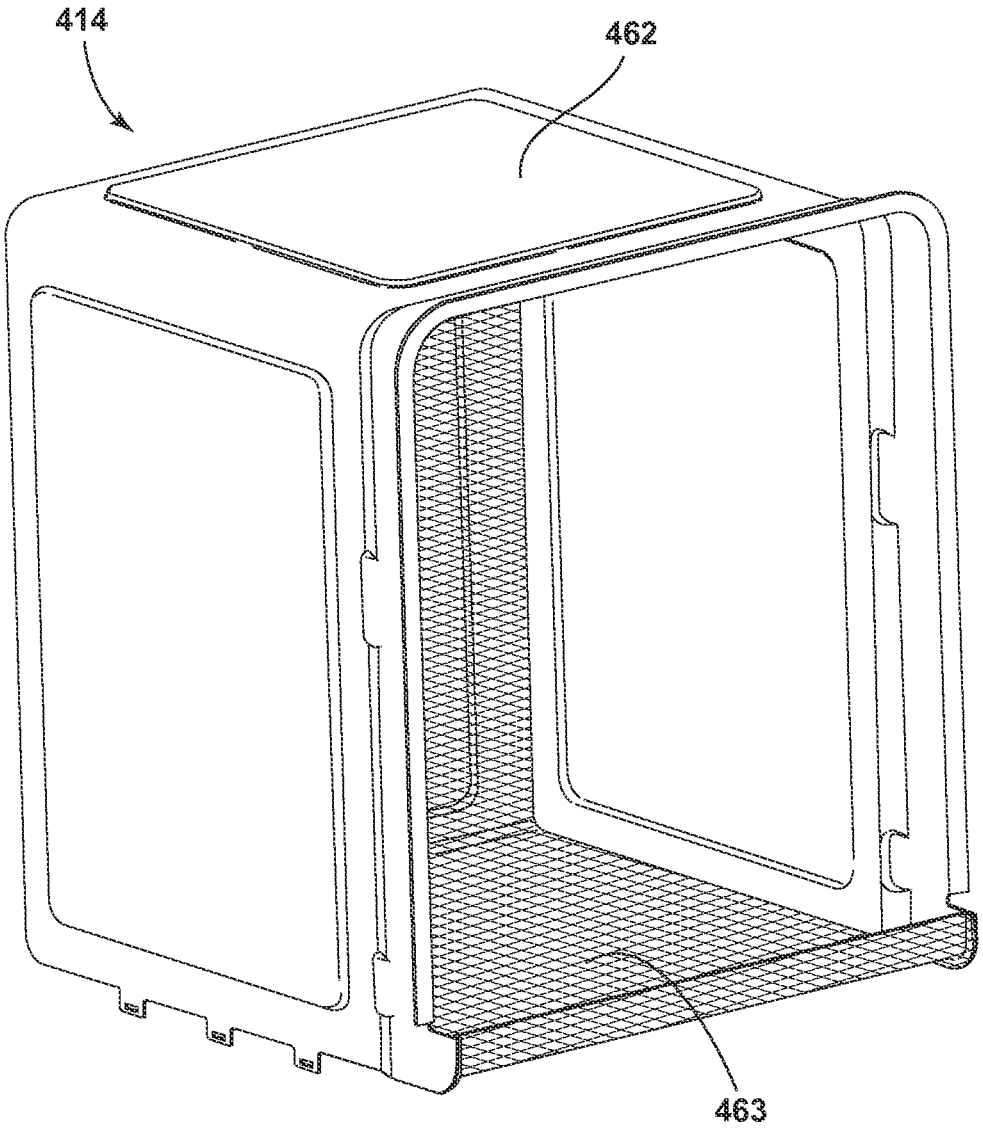
FIG. 13 is a perspective view of a dishwasher tub according to yet another embodiment of the invention.

While the above embodiments have described that the top, bottom, and wrapper may be thermoformed from a single sheet of material or may be thermoformed from separate sheets it will be understood that the thermoformed laminate may be one-piece, two-piece, three-piece, etc. It will also be understood that any combination of the top, bottom, back, and sides may be included in the thermoforming processes. Further, it is contemplated that any of the top, bottom, back, and sides may be combined and thermoformed together as a single piece. By way of non-limiting example, FIG. 13 illustrates yet another embodiment having an alternative tub 414, which may be collectively formed by two pieces according to yet another embodiment. The tub 414 described in this embodiment is similar to the first embodiment; therefore, like parts will be identified with like numerals increased by 400, with it being understood that the description of the like parts of the first embodiment applies to this embodiment, unless otherwise noted.

One difference between the tub 14 and the tub 414 is that the tub 414 is a two-piece tub composed of a wrapper 462 that includes the sidewalls and top of the tub 414 and a single-piece back and bottom 463. The wrapper 462 and the single-piece back and bottom 463 may be joined together to form the five-sided tub 414. The wrapper 462 and the single-piece back and bottom 463 may both be made of any suitable material. Further, the wrapper 462 and the single-piece back and bottom 463 may both be formed in any suitable manner including that both may be thermoformed and folded as described above with respect to the first embodiment. The tub 414 thus achieves a minimum of parts while reducing the complexity of thermoforming the tub 414.

While the invention has been specifically described in connection with certain specific embodiments thereof, it is to be understood that this is by way of illustration and not of limitation. Further, it will be understood that any features of the above described embodiments may be combined in any manner. Reasonable variation and modification are possible within the scope of the forgoing disclosure and drawings without departing from the spirit of the invention which is defined in the appended claims.

What is claimed is:

1. A dishwasher for automatically executing a cycle of operation for treatment of dishes, comprising:

a tub having multiple walls at least partially defining a treating chamber for receiving dishes for treatment and having a wrapper forming at least two adjacent walls of the multiple walls of the tub including at least one sidewall of the tub;

at least one rack mount provided on the at least one sidewall to support a dish rack within the treating chamber;

sprayers for spraying liquid on the dishes; and a liquid recirculation system, for recirculating sprayed liquid back to the sprayers; and wherein the wrapper comprises a thermoformed sheet material and a structural supporting including an arc thermoformed in the sidewall at a location relative to the rack mount to carry a load applied to the sidewall via the rack mount.

2. The dishwasher of claim 1 wherein the arc extends from a lower edge of the sidewall to a front edge of the sidewall.

3. The dishwasher of claim 1 wherein the arc comprises a change in a cross section of the sidewall.

4. The dishwasher of claim 3 wherein the sidewall generally defines a plane and the arc projects beyond the plane.

5. The dishwasher of claim 3 wherein the arc has a concave cross section.

6. The dishwasher of claim 1 wherein the rack mount is located on the arc.

7. The dishwasher of claim 1, wherein the wrapper comprises opposing sidewalls, with each sidewall having an arc.

8. The dishwasher of claim 1 wherein the wrapper comprises opposing sidewalls and a rear wall extending between the opposing sidewalls.

9. The dishwasher of claim 8 wherein the tub further comprises a top wall extending between an upper portion of the sidewalls and the rear wall, and a bottom wall extending between a lower portion of the sidewalls and the rear wall.

10. The dishwasher of claim 9 wherein the top wall and bottom wall are thermoformed from sheet material.

11. The dishwasher of claim 9 wherein at least one of a top and a bottom of the tub is formed from metal.

12. A dishwasher for automatically executing a cycle of operation for treatment of dishes, comprising:

a tub having multiple walls at least partially defining a treating chamber for receiving dishes for treatment wherein at least one sidewall comprises a thermoformed sheet material;

sprayers for spraying liquid on the dishes;

a liquid recirculation system, for recirculating sprayed liquid back to the sprayers;

at least one rack mount provided on the sidewall to support a dish rack within the treating chamber; and a structural support in the form of an arc thermoformed in the sidewall at a location relative to the rack mount to carry a load applied to the sidewall via the rack mount.

13. The dishwasher of claim 12 wherein the thermoformed sheet material comprises a laminate having multiple layers.

14. The dishwasher of claim 13 wherein at least one of the layers comprises:

a) an impact resistant layer;

b) a stain-resistant layer;

c) an abrasion-resistant layer;

d) an aesthetic layer;

e) an acoustic layer; and f) a structural layer.

15. The dishwasher of claim 13 wherein the laminate comprises an acoustic layer disposed between an aesthetic layer and a structural layer.

16. The dishwasher of claim 13 wherein one of the layers comprises an interior layer corresponding to an interior of the tub and wherein the interior layer is stain-resistant.

17. The dishwasher of claim 16 wherein the interior layer is formed from oriented polypropylene.

18. The dishwasher of claim 16 wherein the interior layer overlies non-stain resistant layers.

19. The dishwasher of claim 13 wherein the laminate having multiple layers comprises multiple sound attenuating layers.

20. The dishwasher of claim 19 wherein each of the multiple sound attenuating layers attenuates a different frequency.

21. The dishwasher of claim 13 wherein the laminate having multiple layers comprises two layers having different thermal expansion properties.

22. The dishwasher of claim 21, further comprising a flexible layer between the two layers having different thermal expansion properties.

* * * * *